US005632291A

United States Patent [19]

Botbyl et al.

[11] Patent Number: 5,632,291

[45] Date of Patent: May 27, 1997

[54] CIRCULAR AIR MATTRESS AND TENT

[76] Inventors: Marinus Botbyl; Nelly Botbyl, both of 16 Grammar Avenue, St. Catherines, Ontario, Canada, L2N 3L3

[21] Appl. No.: 488,168

[22] Filed: Jun. 12, 1995

[51] Int. Cl.[6] ..... E04H 15/56; A47C 27/08

[52] U.S. Cl. ..... 135/116; 137/137; 5/711; 5/706; 5/925; 5/420

[58] Field of Search ..... 5/417, 420, 425, 5/432, 711, 707, 706; 135/116, 124, 137; 52/2.11

[56] References Cited

U.S. PATENT DOCUMENTS

| | | | |
|---|---|---|---|
| 1,738,411 | 12/1929 | Welch | 5/449 |
| 2,822,554 | 2/1958 | Wenzelberger | 5/449 |
| 4,056,858 | 11/1977 | Weber | 5/449 |
| 4,516,767 | 5/1985 | Eskijian | 5/420 |
| 4,860,395 | 8/1989 | Smith | 5/420 |
| 5,487,400 | 1/1996 | Dawkins | 135/124 |

FOREIGN PATENT DOCUMENTS

| | | | |
|---|---|---|---|
| 405179837 | 7/1993 | Japan | 52/2.11 |

OTHER PUBLICATIONS

"Special Water Mattress", Waterbed Magazine, p. 24.

*Primary Examiner*—Flemming Saether

[57] ABSTRACT

An air mattress for supporting an individual within a circular tent. The inventive device includes a circular upper web coupled to a circular lower web by a perimeter sidewall extending therebetween. An air valve is directed through the sidewall for permitting pneumatic inflation of the mattress. A plurality of spacing projections extend from the lower circular web and cooperate to support the mattress above a floor web of an associated tent.

1 Claim, 4 Drawing Sheets

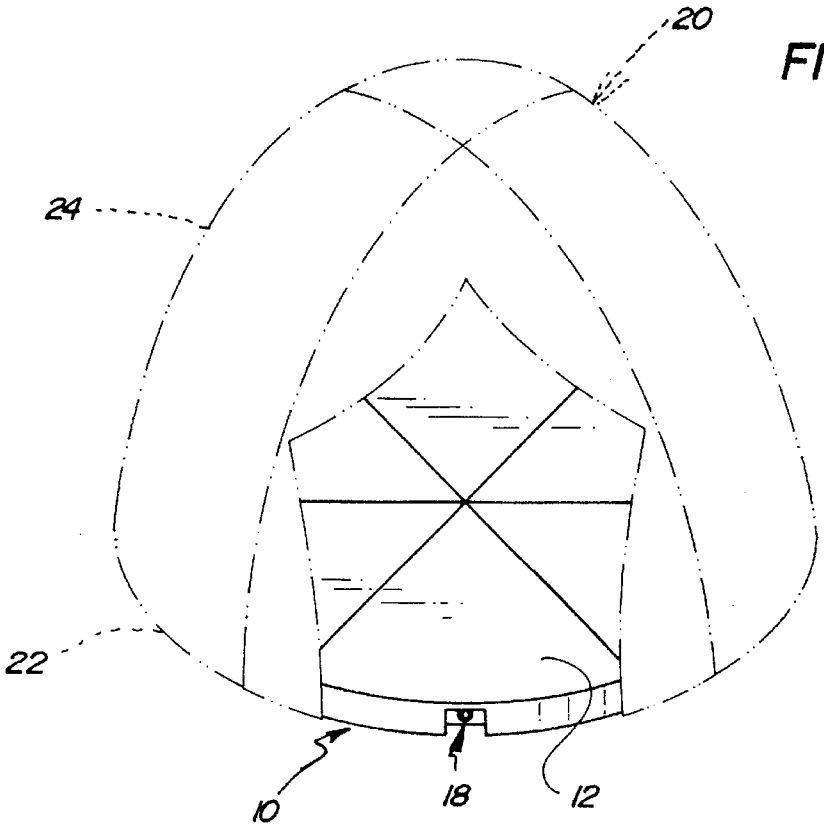
FIG. 1
FIG. 2
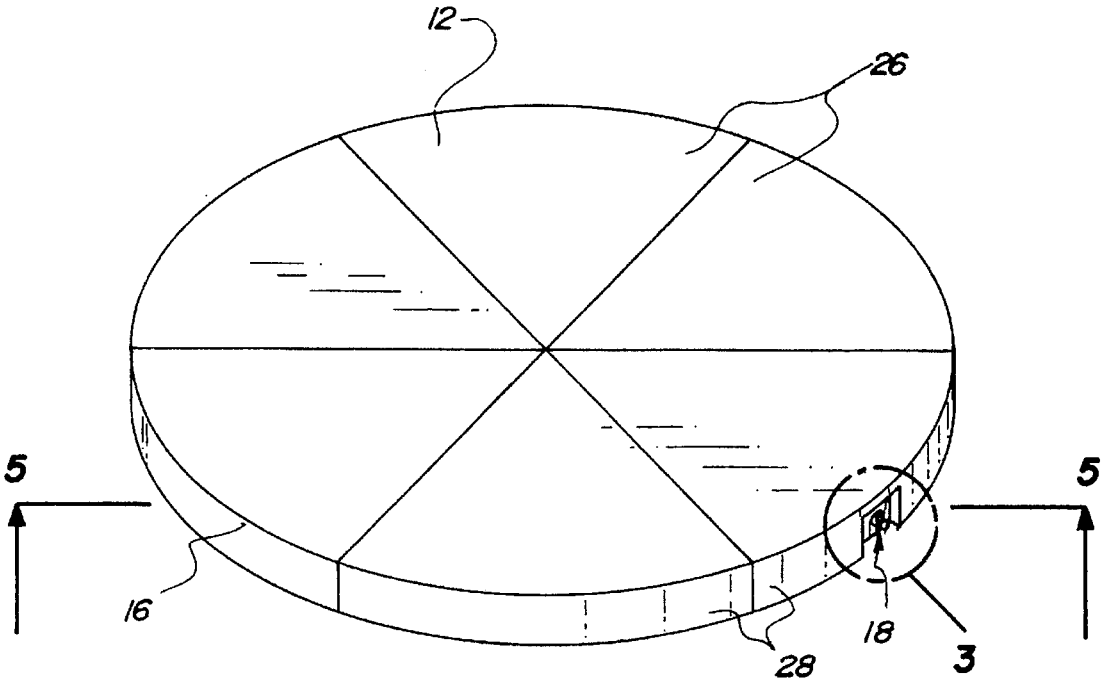

CIRCULAR AIR MATTRESS AND TENT

BACKGROUND OF THE INVENTION

1. Field of the Invention

The present invention relates to mattress structures and more particular pertains to a circular air mattress for supporting an individual within a circular tent.

2. Description of the Prior Art

The use of mattress structures is known in the prior art. More specifically, mattress structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art mattress structures include U.S. Pat. No. 4,860,395; U.S. Pat. No. 4,067,077; U.S. Pat. No. 5,303,435; U.S. Pat. No. 5,191,665; U.S. Pat. No. 3,711,875; and U.S. Pat. No. 5,133,098.

While these devices fulfill their respective, particular objectives and requirements, the aforementioned patents do not disclose a circular air mattress for supporting an individual within a circular tent which includes a circular upper web coupled to a circular lower web by a perimeter side wall extending therebetween, an air valve directed through the side wall for permitting pneumatic inflation of the mattress, and a plurality of spacing projections extending from the lower circular web and cooperating to support the mattress above a floor web of an associated tent.

In these respects, the circular air mattress according to the present invention substantially departs from the conventional concepts and designs of the prior art, and in so doing provides an apparatus primarily developed for the purpose of supporting an individual within a circular tent.

SUMMARY OF THE INVENTION

In view of the foregoing disadvantages inherent in the known types of mattress structures now present in the prior art, the present invention provides a new circular air mattress construction wherein the same can be utilized for supporting an individual within a tent or other structure. As such, the general purpose of the present invention, which will be described subsequently in greater detail, is to provide a new circular air mattress apparatus and method which has many of the advantages of the mattress structures mentioned heretofore and many novel features that result in a circular air mattress which is not anticipated, rendered obvious, suggested, or even implied by any of the prior art mattress structures, either alone or in any combination thereof.

To attain this, the present invention generally comprises an air mattress for supporting an individual within a circular tent. The inventive device includes a circular upper web coupled to a circular lower web by a perimeter sidewall extending therebetween. An air valve is directed through the sidewall for permitting pneumatic inflation of the mattress. A plurality of spacing projections extend from the lower circular web and cooperate to support the mattress above a floor web of an associated tent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new circular air mattress apparatus and method which has many of the advantages of the mattress structures mentioned heretofore and many novel features that result in a circular air mattress which is not anticipated, rendered obvious, suggested, or even implied by any of the prior art tool guides, either alone or in any combination thereof.

It is another object of the present invention to provide a new circular air mattress which may be easily and efficiently manufactured and marketed.

It is a further object of the present invention to provide a new circular air mattress which is of a durable and reliable construction.

An even further object of the present invention is to provide a new circular air mattress which is susceptible of a low cost of manufacture with regard to both materials and labor, and which accordingly is then susceptible of low prices of sale to the consuming public, thereby making such circular air mattresses economically available to the buying public.

Still yet another object of the present invention is to provide a new circular air mattress which provides in the apparatuses and methods of the prior art some of the advantages thereof, while simultaneously overcoming some of the disadvantages normally associated therewith.

Still another object of the present invention is to provide a new circular air mattress for supporting an individual within a circular tent.

Yet another object of the present invention is to provide a new circular air mattress which includes a circular upper web coupled to a circular lower web by a perimeter side wall extending therebetween, an air valve directed through the side wall for permitting pneumatic inflation of the mattress, and a plurality of spacing projections extending from the lower circular web and cooperating to support the mattress above a floor web of an associated tent.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a circular air mattress according to the present invention in use.

FIG. 2 is an isometric illustration of the invention, per se.

DESCRIPTION OF THE PREFERRED EMBODIMENT

Figure 3:
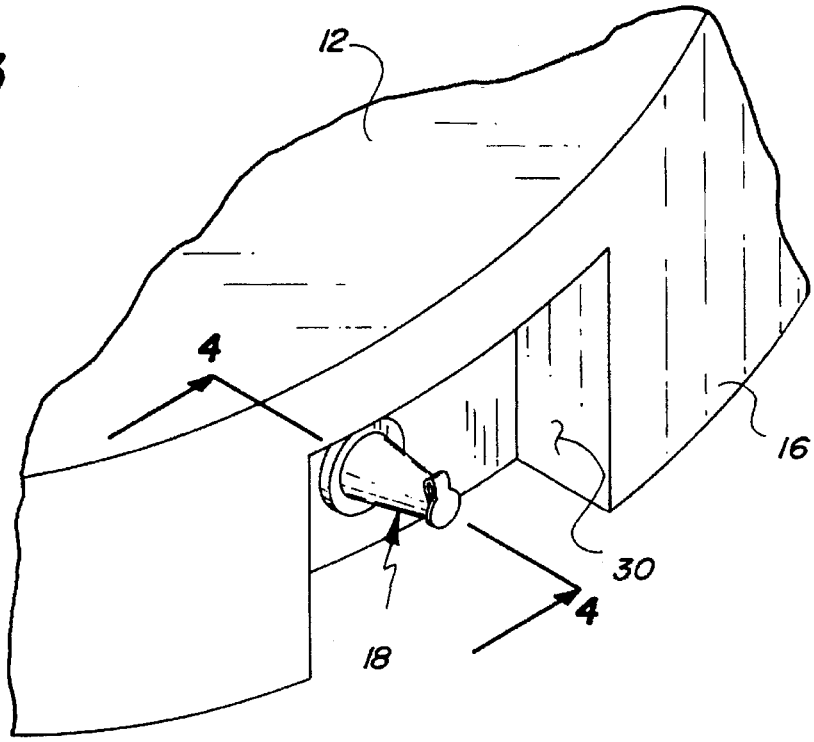
FIG. 3 is an enlarged isometric illustration of the area set forth in FIG. 2

With reference now to the drawings, and in particular to FIGS. 1–8 thereof, a circular air mattress embodying the principles and concepts of the present invention and generally designated by the reference numeral 10 will be described.

More specifically, it will be noted that the circular air mattress 10 comprises an upper circular web 12 of flexible and air impermeable construction positioned in a substantially spaced orientation relative to a similarly constructed lower circular web 14, as shown in FIGS. 1 through 5 of the drawings. A perimeter side wall 16 is coupled to an outer peripheral edge of the upper circular web 12 and extends substantially orthogonally therefrom so as to couple with an outer peripheral edge of the lower circular web 14. An air valve 18 is directed through the perimeter side wall 16 and permits a pneumatic inflation of the mattress 10, whereby pneumatic pressure between the upper circular web 12 and the lower circular web 14 as contained by the perimeter side wall 16 extending therebetween can support individual in a spaced relationship relative to a ground surface. By this structure, the mattress 10 can be easily positioned within a domed tent 20, as shown in FIG. 1 of the drawings, so as to reside upon a floor web 22 of the tent and within a hemi-spherical canopy web 24 substantially as shown. Preferably, the lower circular web 14 is shaped so as to be substantially coextensive relative to the floor web 22 of the domed tent 20, whereby a possibility of an individual rolling from the mattress 10 onto the floor web 22 is substantially eliminated.

As shown in FIG. 2, the upper circular web 12 may be comprised of a plurality of wedge-shaped webs 26 which are stitched or otherwise sealingly secured together so as to form the upper circular web 12. Further, the perimeter side wall 16 can be formed of a plurality of arcuate shaped webs 28 which are also stitched or otherwise sealingly coupled together so as to permit for ease of construction of the device 10.

Figure 4:
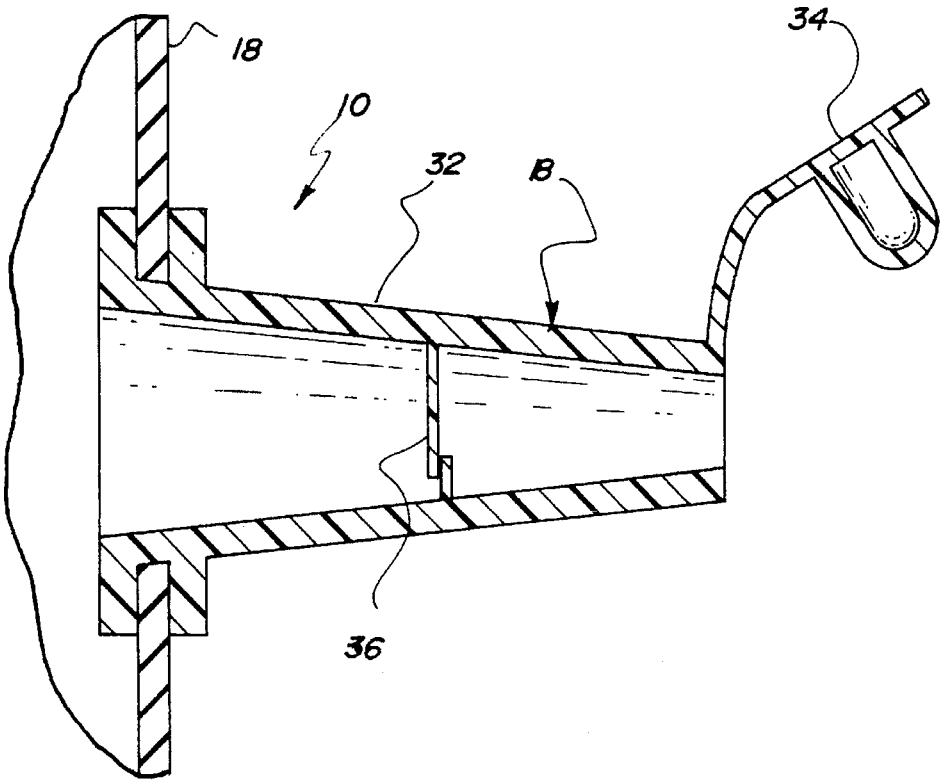
FIG. 4 is a cross sectional view taken along line 4—4 of FIG. 3.

Referring now to FIGS. 3 and 4, it can be shown that the air valve 18 of the present invention 10 is preferably mounted within a recessed area formed into the perimeter side wall 16 such that the air valve 18 does not project laterally beyond the perimeter side wall. Such configuration of the portion of the perimeter side wall 16 where the air valve 18 is mounted precludes interference of the air valve 18 against an interior surface of the hemi-spherical canopy web 24 when the device 10 is positioned within the domed tent 20 as illustrated in FIG. 1. As shown in FIG. 4, the air valve 18 comprises a nozzle 32 projecting through an unlabeled aperture in the perimeter side wall 16 which terminates in an outer distal end. A plug 34 is tethered to the outer distal end of the nozzle 32 and can be inserted thereinto so as to preclude fluid communication through the nozzle 32. Further, a check valve 36 can be located within the nozzle 32 so as to permit a one way direction of air therethrough into the mattress 10. By this structure, pneumatic inflation of the air mattress can be easily effected through a manual or powered injection of the air through the nozzle 32.

Figure 5:
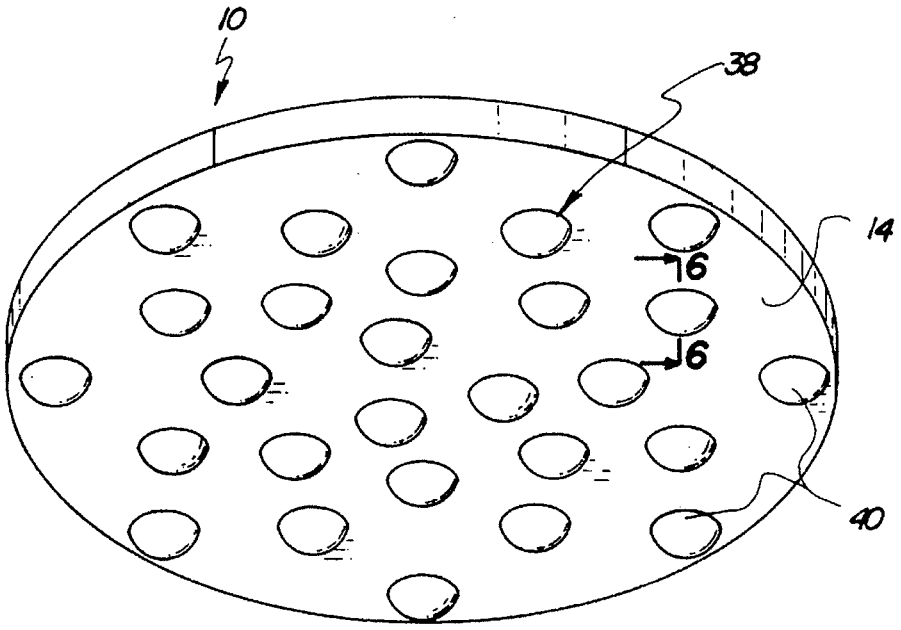
FIG. 5 is a bottom isometric illustration of the invention including a spacing means.
Figure 6:
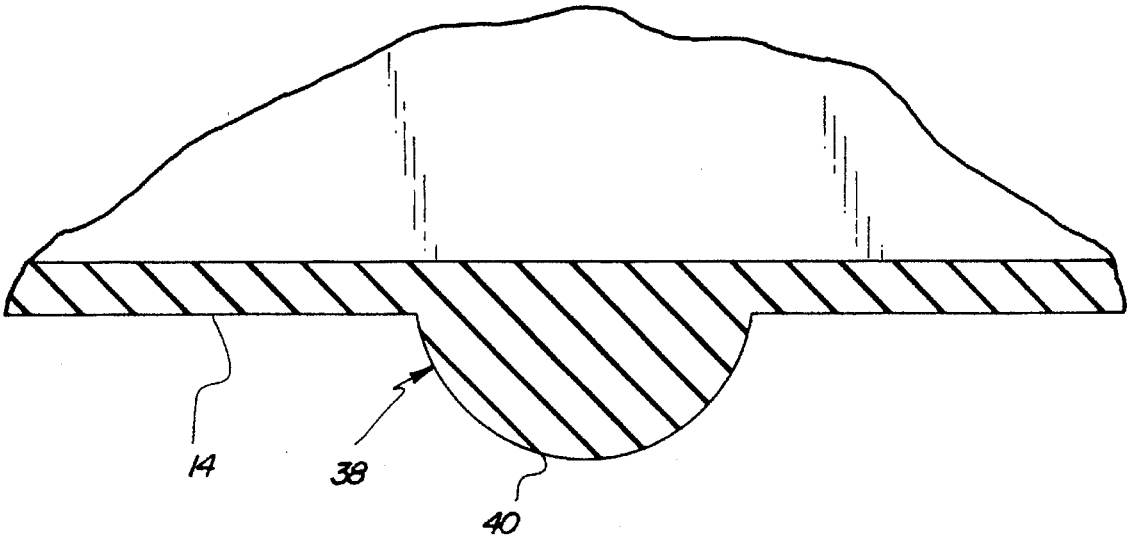
FIG. 6 is a cross sectional view taken along line 6—6 of FIG. 5.

Referring now to FIGS. 5 and 6, it can be shown that the present invention 10 may further comprise a plurality of spacing means 38 extending from the lower circular web 14 for supporting the lower circular web in a spaced relationship relative to a floor web 22 of the domed tent 20 when the device 10 is positioned thereinto as shown in FIG. 1 of the drawings. To this end, the spacing means 38 preferably comprises a plurality of hemi-spherical projections 40 which are integrally or otherwise fixedly secured to the lower circular web 14 and project therefrom as shown in FIG. 6. The hemi-spherical projections 40 permit air to circulate between the lower circular web 14 and a floor web 22 of the domed tent 20 so as to preclude a retention of water between the webs 14 and 22. The shape of the hemi-spherical projection 40 permits air to freely flow between the lower circular web 14 and the floor web 22 without substantially obstructing such airflow.

Figure 7:
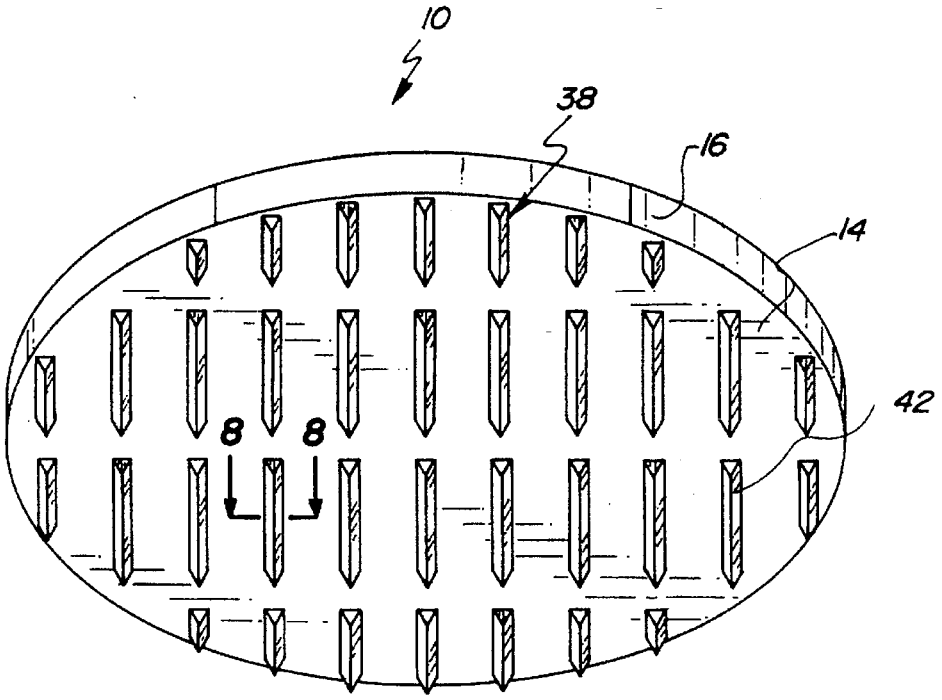
FIG. 7 is a bottom isometric illustration of the invention including an alternative form of the spacing means.
Figure 8:
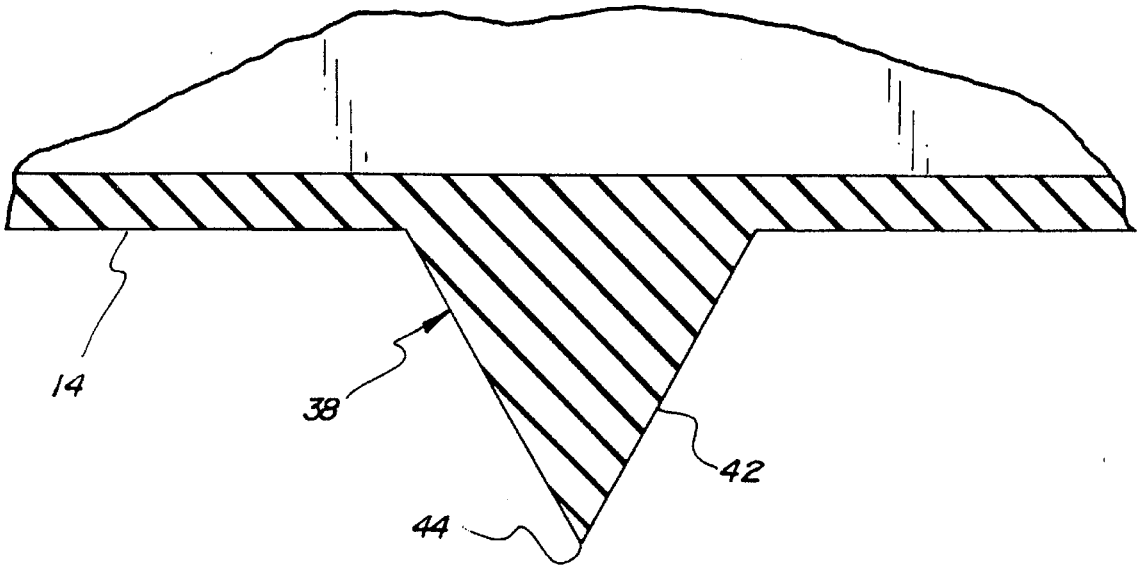
FIG. 8 is a cross sectional view taken along line 8—8 of FIG. 7.

Referring now to FIGS. 7 and 8 wherein an alternative form of the spacing means 38 is illustrated, it can be shown that the spacing means 38 may alternatively comprise a plurality of elongated ribs 42 which extend in a co-linearly aligned matrix across a bottom of the lower circular web 14. Preferably, the elongated ribs 42 are shaped so as to define a triangular cross section projecting from the lower circular web 14 and terminating in an engaging apex 44.

In use, the circular air mattress 10 according to the present invention can be easily utilized for supporting an individual within a circular domed tent 20 as illustrated in FIG. 1 of the drawings. The present invention 10 can be easily inflated and/or deflated so as to permit for ease of compact transportation and/or storage thereof.

As to a further discussion of the manner of usage and operation of present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A combination tent and circular air mattress comprising:

an upper circular web of flexible and air impermeable construction, the upper circular web comprising a plurality of wedge-shaped webs stitched together;

a lower circular web of flexible and air impermeable construction positioned in a substantially spaced orientation relative to the upper circular web;

a perimeter side wall coupled to an outer peripheral edge of the upper circular web and extending substantially orthogonally therefrom, the perimeter side wall being coupled to an outer peripheral edge of the lower circular web, the perimeter side wall being formed of a plurality of arcuate shaped webs stitched together, the perimeter side wall being shaped so as to define a recessed area formed thereinto;

an air valve directed through the perimeter side wall and permitting a pneumatic inflation of the mattress, whereby pneumatic pressure between the upper circular web and lower circular web as contained by the perimeter side wall extending therebetween can support an individual in a spaced relationship relative to a ground surface, the air valve being mounted within the recess of the perimeter side wall, the air valve comprising a nozzle projecting through an aperture in the perimeter side wall, the nozzle terminating in an outer distal end spaced from the side wall; a plug tethered to the outer distal end of the nozzle and removably inserted thereinto so as to preclude fluid communication through the nozzle, and a check valve positioned within the nozzle;

a plurality of spacing means extending from the lower circular web for supporting the lower circular web in a spaced relationship relative to a ground surface, the spacing means comprising a plurality of elongated ribs which are coupled to and extend in a co-linearly aligned matrix across a bottom of the lower circular web, the elongated ribs each being shaped so as to define a triangular cross-section, the elongated ribs each projecting from the lower circular web and terminating in an engaging apex; and a domed tent having a floor web, the air mattress being positioned within the domed tent, with the lower circular web being shaped so as to be substantially coextensive relative to the floor web of the domed tent, with the spacing means maintaining the lower circular web in a spaced orientation relative to the floor web of the tent.

* * * * *